US006820747B2

(12) United States Patent
Watters et al.

(10) Patent No.: US 6,820,747 B2
(45) Date of Patent: Nov. 23, 2004

(54) SCREEN ASSEMBLY

(75) Inventors: Larry A. Watters, McMurray, PA (US); Daniel S. Placha, Oakdale, PA (US)

(73) Assignee: Sedgman, LLC, Pittsburgh, PA (US)

( * ) Notice: Subject to any disclaimer, the term of this patent is extended or adjusted under 35 U.S.C. 154(b) by 18 days.

(21) Appl. No.: 10/095,860

(22) Filed: Mar. 12, 2002

(65) Prior Publication Data

US 2003/0173268 A1 Sep. 18, 2003

(51) Int. Cl.[7] ..... B07B 1/00
(52) U.S. Cl. ..... 209/275; 209/277
(58) Field of Search ..... 209/17, 315, 264, 209/274, 275, 276, 277, 281, 282, 906

(56) References Cited

U.S. PATENT DOCUMENTS

| | | | | | |
|---|---|---|---|---|---|
| 417,907 | A | * | 12/1889 | Coplen | 209/349 |
| 646,955 | A | * | 4/1900 | Craig | 209/339 |
| 678,819 | A | * | 7/1901 | Watkins | 209/404 |
| 1,915,602 | A | * | 6/1933 | Goody | 209/273 |
| 2,942,730 | A | * | 6/1960 | Fontein | 209/274 |
| 2,976,996 | A | * | 3/1961 | Fontein | 209/355 |
| 4,319,993 | A | * | 3/1982 | Krause | 209/315 |
| 5,676,710 | A | | 10/1997 | Chedgy | |

* cited by examiner

*Primary Examiner*—Donald P. Walsh
*Assistant Examiner*—Joseph Rodriguez
(74) *Attorney, Agent, or Firm*—Buchanan Ingersoll, PC

(57) ABSTRACT

In a coal preparation plant which receives a raw coal feed and separates the raw coal feed into clean coal feed and refuse feed slurries using a media based separation process, an apparatus is provided for use therein. The inventive apparatus simultaneously processes the raw coal feed and clean coal feed and refuse feed slurries, while occupying minimal floor space within the coal preparation plant. The inventive apparatus includes a unitary vibrating screen assembly having a length and a width, wherein the width of the vibrating screen assembly is partitioned into three screen sections extending the length of the vibrating screen assembly. A deslime screen section receives the raw coal feed and separates the raw coal feed into coarse and fine sized fractions as the raw coal feed moves along the length of the deslime screen section. A refuse screen section receives the refuse feed slurry and removes separation media therefrom as the refuse feed slurry moves along the length of the refuse screen section. Similarly, a clean coal screen section receives the clean coal feed slurry and removes separation media therefrom as the clean coal feed slurry moves along the length of the clean coal screen section.

20 Claims, 6 Drawing Sheets

SCREEN ASSEMBLY

FIELD OF THE INVENTION

The present invention is directed generally toward coal preparation plants and, more particularly, toward an improved screen assembly apparatus for use in coal preparation plants.

BACKGROUND OF THE INVENTION

Coal preparation plants separate organic and non-organic solid particles by their specific gravities. The coal preparation plant receives a feed of raw mined coal, and separates the raw mined coal into clean coal and refuse. These plants typically utilize two basic processing methods for separating raw coal from rock and varying proportions of striated rock and coal from the higher quality coal. The two processing methods include heavy media and water based separation methods. Heavy media, utilizing a slurry of media, e.g., water and magnetite or ferrosilicon, to separate the coal from the refuse according to their specific gravity of dry solids, is the most common separation process for larger size (Plus 1 mm–0.5 mm) particles. Whereas, water based separation processes are more commonly used for the "cleaning" of the finer sized particles, as that term is conventionally understood in the coal processing art. One type of heavy media circuitry used in the coal preparation plants includes a heavy media cyclone.

Coal preparation plants using heavy media cyclones operate with three separate types of screens for coal processing, namely, a deslime screen, a refuse screen and a clean coal screen. A common screening assembly used in many coal preparation plants is today known as a vibratory banana screen. The deslime screen receives the raw coal feed particles and separates them into coarse and fine sized fractions. The coarse or larger sized particles discharged from the screen surface are directed to the heavy media separation section of the coal preparation plant, while the finer sized particles passing through the deslime screen are directed toward the water based separation section of the coal preparation plant.

The separate clean coal and refuse screens receive the clean coal and refuse particles, respectively produced by the heavy media separating section. While on the clean coal and refuse screens, the clean coal and refuse particles are rinsed with water, and the finer particles and water passing through the respective screens are recirculated through the coal preparation plant. Rinsing the clean coal and refuse particles is primarily done to recover the particles of media, such as magnetite, remaining thereon as a result of the coal/refuse separation process, as magnetite can be quite expensive.

Often, the deslime, clean coal and refuse screens are located in different areas of the coal preparation plant and/or on different floors. In addition to being an inefficient use of space and increasing the cost of the coal preparation plant, this situation creates a burden for the plant operator wishing to view the feeds and discharges of raw coal, clean coal and refuse screens.

The present invention is directed toward overcoming one or more of the above-mentioned problems.

SUMMARY OF THE INVENTION

In a coal preparation plant which receives a raw coal feed and separates the raw coal feed into clean coal and refuse particles using a media based separation process, an apparatus is provided for use therein. The inventive apparatus simultaneously processes the raw coal feed, clean coal and refuse particles, while occupying minimal floor space within the coal preparation plant. The inventive apparatus includes a unitary vibrating screen assembly having a length and a width, wherein the width of the vibrating screen assembly is partitioned into three screen sections extending the length of the vibrating screen assembly. A deslime screen section receives the raw coal feed particles and separates the raw coal feed particles into coarse and fine sized fractions as the raw coal feed particles move along the length of the deslime screen section. Two separate drain and rinse sections of the screen receive the refuse and clean coal particles, respectively, and remove media remaining on these particles as they move along the length of the respective screen section.

Typically, the various feed particles are moved along the length of the unitary vibrating screen assembly via gravitational and/or vibrating forces. The unitary vibrating screen assembly may be of single or double deck construction, as those terms are conventionally understood in the coal processing art.

In one form, the deslime screen section includes an underpan receiving the fine sized raw coal feed particles passing through the deslime screen section. The fine sized raw coal feed particles received by this underpan are passed to a fine coal, or water based, processing section of the coal preparation plant. The two separate drain and rinse sections each include a separate underpan receiving the media particles which pass through the respective screen section and are recovered from the refuse and clean coal particles. The recovered media particles received by these underpans are recirculated through and/or further processed by the coal preparation plant.

The underpans of the two separate drain and rinse sections may be combined into a single underpan receiving the recovered media particles passing through the screen sections, respectively, for recirculation through and/or further processing by the coal preparation plant.

Sprayers are provided for adding water onto the deslime screen section, and the two separate drain and rinse screen sections to rinse the raw coal feed, refuse and clean coal particles, respectively. Water is used to aid in particle separation in the deslime screen section and also to remove media from the refuse and clean coal particles in the two drain and rinse screen sections, respectively.

In another form, partition members are provided lengthwise along the unitary vibrating screen assembly extending vertically therefrom to partition the unitary vibrating screen assembly into the deslime and the two separate drain and rinse screen sections.

In a preferred form, the inventive unitary vibrating screen assembly includes a multislope "banana" screen of either a single or double deck configuration.

It is an object of the present invention to:

- provide an improved screen assembly in a coal preparation plant occupying minimal space; and
- to provide an improved screen assembly for simultaneously processing raw coal feed, refuse feed and clean coal feed particles.

Other objects, aspects and advantages of the present invention can be obtained from a study of the specification, the drawings, and the appended claims.

DETAILED DESCRIPTION OF THE INVENTION

Figure 1:
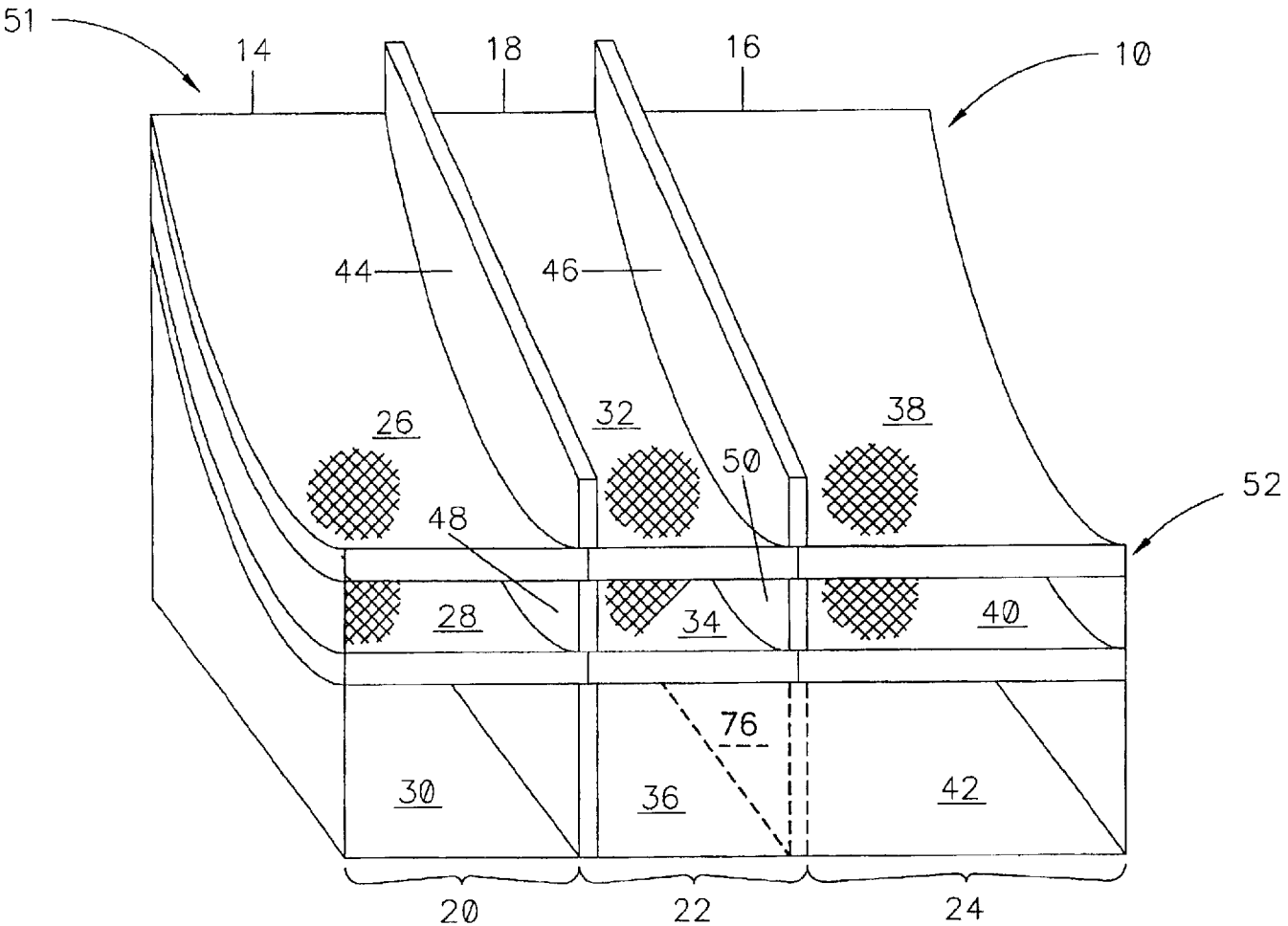
FIG. 1 is a perspective view of a screen assembly according to the present invention.
Figure 2:
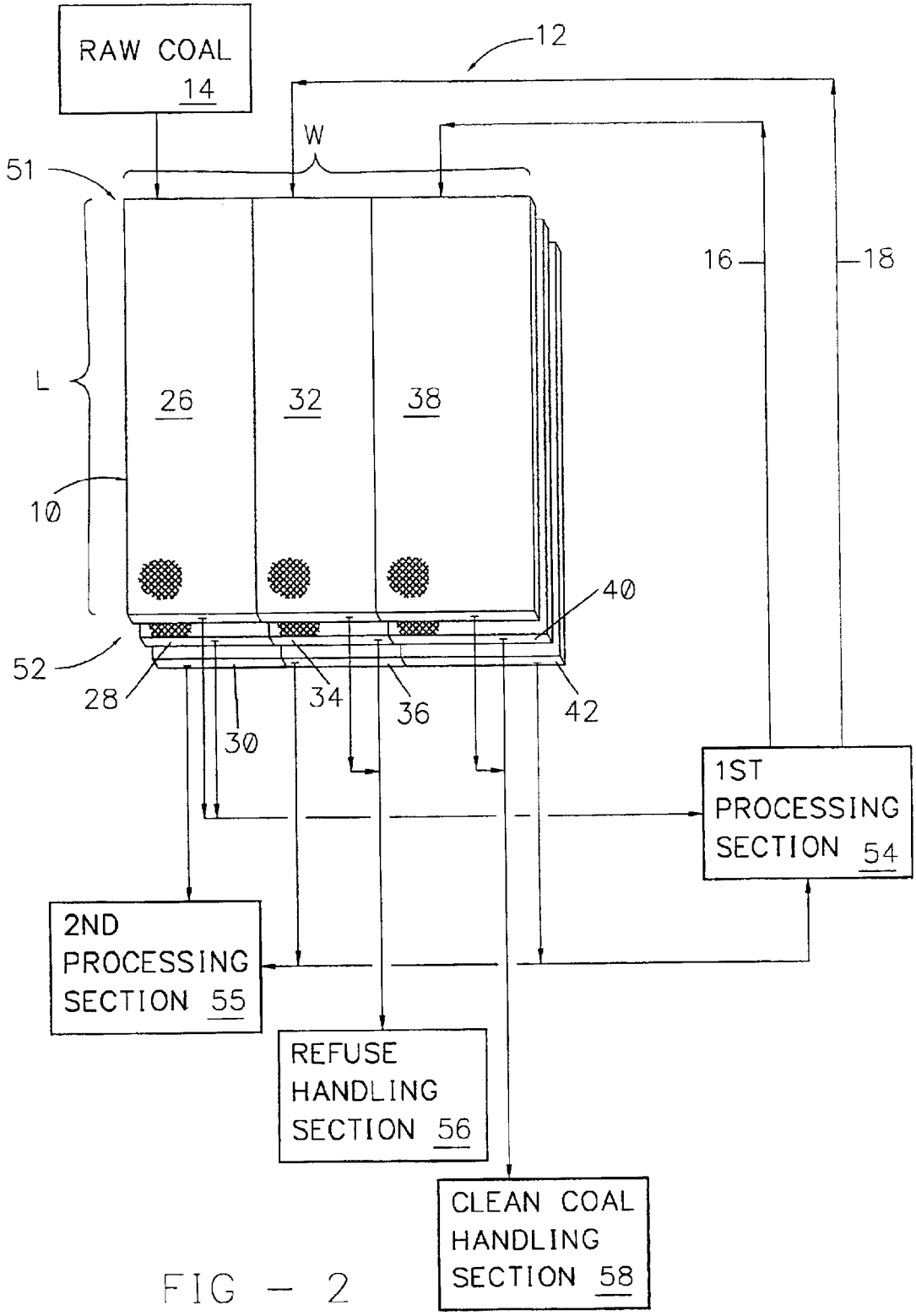
FIG. 2 is a block diagram of a coal preparation plant incorporating the inventive screen assembly.
Figure 3:
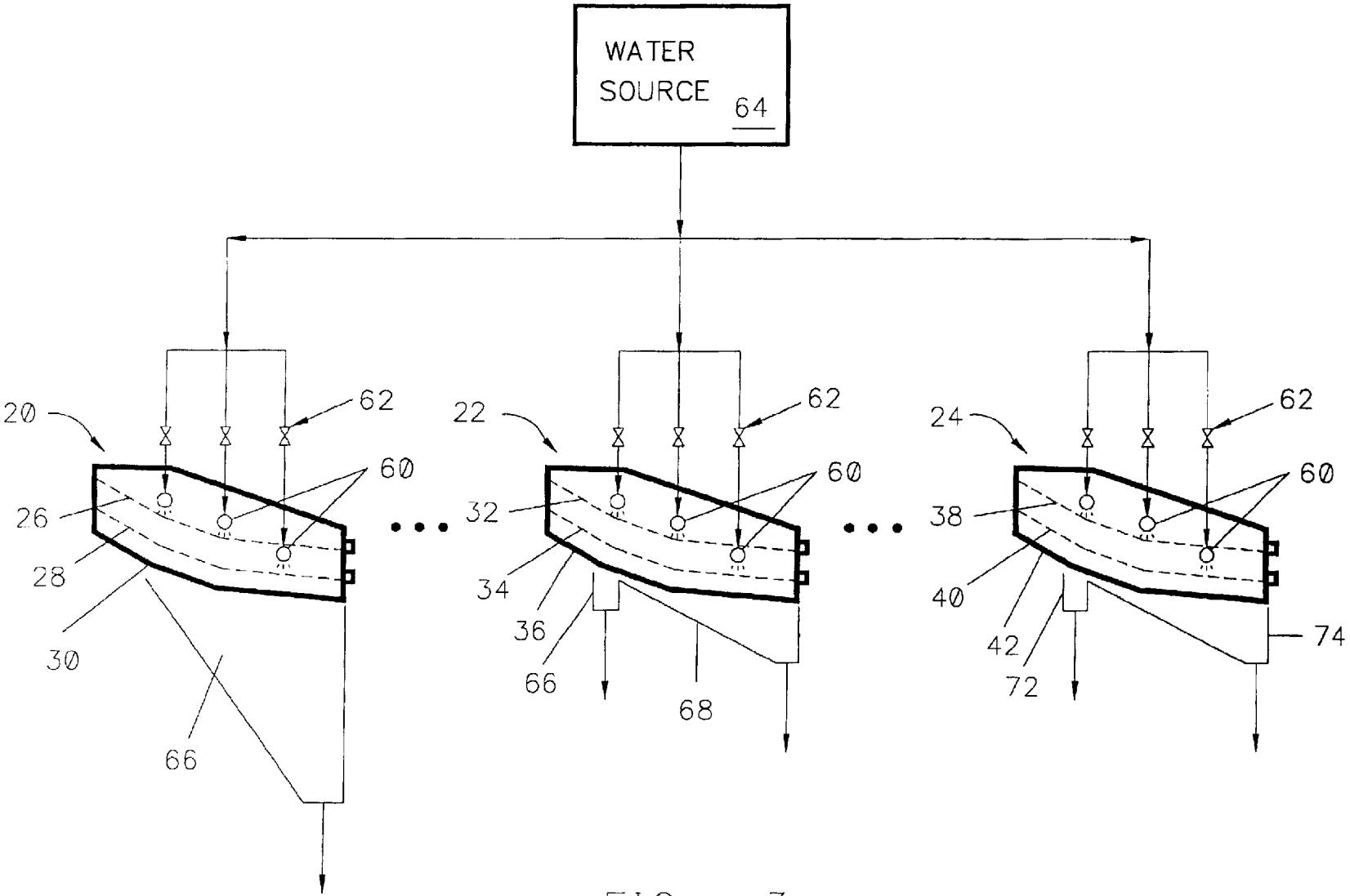
FIG. 3 is an exploded perspective view of the inventive screen assembly with partition members removed.

Referring to FIGS. 1–2, the inventive screen assembly 10 is shown incorporated for use within a coal preparation plant 12. The coal preparation plant 12 typically receives a raw coal feed 14 and separates the raw coal feed 14 into clean coal 16 and refuse 18 particles. The inventive screen assembly 10 includes a unitary screen assembly for simultaneously processing the raw coal feed 14, clean coal 16 and refuse 18 particles. The screen assembly 10 has a length "l" and a width "w" and is partitioned into deslime 20, refuse 22 and clean coal 24 screen sections extending lengthwise, with each section receiving and processing a different type of feed particle.

The deslime screen section 20 includes top 26 and bottom 28 deck screens. The top screen 26 includes a mesh which is larger than the mesh of the bottom screen 28. The bottom screen 28 is disposed directly below the top screen 26, and as the raw coal feed 14 is passed across the length of the deslime screen section 20, the top 26 and bottom 28 screens screen the coarse raw coal feed particles from the finer sized particles which fall through the screens 26 and 28 and into an underpan 30 disposed below the top 26 and bottom 28 screens. As a result of the larger mesh of the top screen 26, the coarse raw coal feed particles 14 screened by the top screen 26 are of a larger diameter than those screened by the bottom screen 28.

The refuse screen section 22 also includes top 32 and bottom 34 deck screens, with the bottom screen 34 disposed below the top screen 32. The top screen 32 has a mesh which is larger than the mesh of the bottom screen 34. As the refuse particles 18 are passed across the length of the refuse screen section 22, the solid refuse particles are screened by the top 32 and bottom 34 screens, with the finer sized particles of refuse (misplaced refuse fines) passing through the screens 32 and 34 to an underpan 36 disposed below the top 32 and bottom 34 screens. As a result of the larger mesh of the top screen 32, the solid refuse particles 18 screened by the top screen 32 are of a larger diameter than those screened by the bottom screen 34.

Similarly, the clean coal screen section 24 includes top 38 and bottom 40 deck screens, with the bottom screen 40 disposed below the top screen 38. The top screen 38 has a mesh which is larger than the mesh of the bottom screen 40. As the clean coal particles 16 are passed across the length of the clean coal screen section 24, the solid clean coal particles are screened by the top 38 and bottom 40 screens, with the finer sized clean coal particles (misplaced clean coal fines) passing through the screens 38 and 40 and into an underpan 42 disposed below the top 38 and bottom 40 screens. As a result of the larger mesh of the top screen 38, the solid clean coal feed particles 16 screened by the top screen 38 are of a larger diameter than those screened by the bottom screen 40.

As shown in FIG. 1, each of the screens 26, 28, 32, 34, 38 and 40 are sloped such that the inventive screen assembly type is of the type conventionally known as a banana screen. The top screens 26, 32 and 38 together constitute a first screen deck, while the bottom screens 28, 34 and 40 together constitute a second screen deck.

A first partition member 44 separates the deslime 20 and refuse 22 screen sections. Similarly, a second partition member 46 separates the refuse 22 and clean coal 24 screen sections. The first 44 and second 46 partition members extend vertically from, and substantially normal to, the top screens 26, 32 and 38. Similarly, third 48 and fourth 50 partition members extend vertically from the bottom screens 28, 34 and 40 up to the top screens 26, 32 and 38 and partition the bottom screens 28, 34 and 40 into the deslime 20, refuse 22 and clean coal 24 screen sections, respectively. Specifically, the third partition member 48 separates the deslime screen section 20 from the refuse screen section 22, while the fourth partition member 50 separates the refuse screen section 22 from the clean coal screen section 24. Typically, the partition members 44, 46, 48 and 50 will be bolted to the frame (not shown) of the screen assembly 10.

Figure 4:
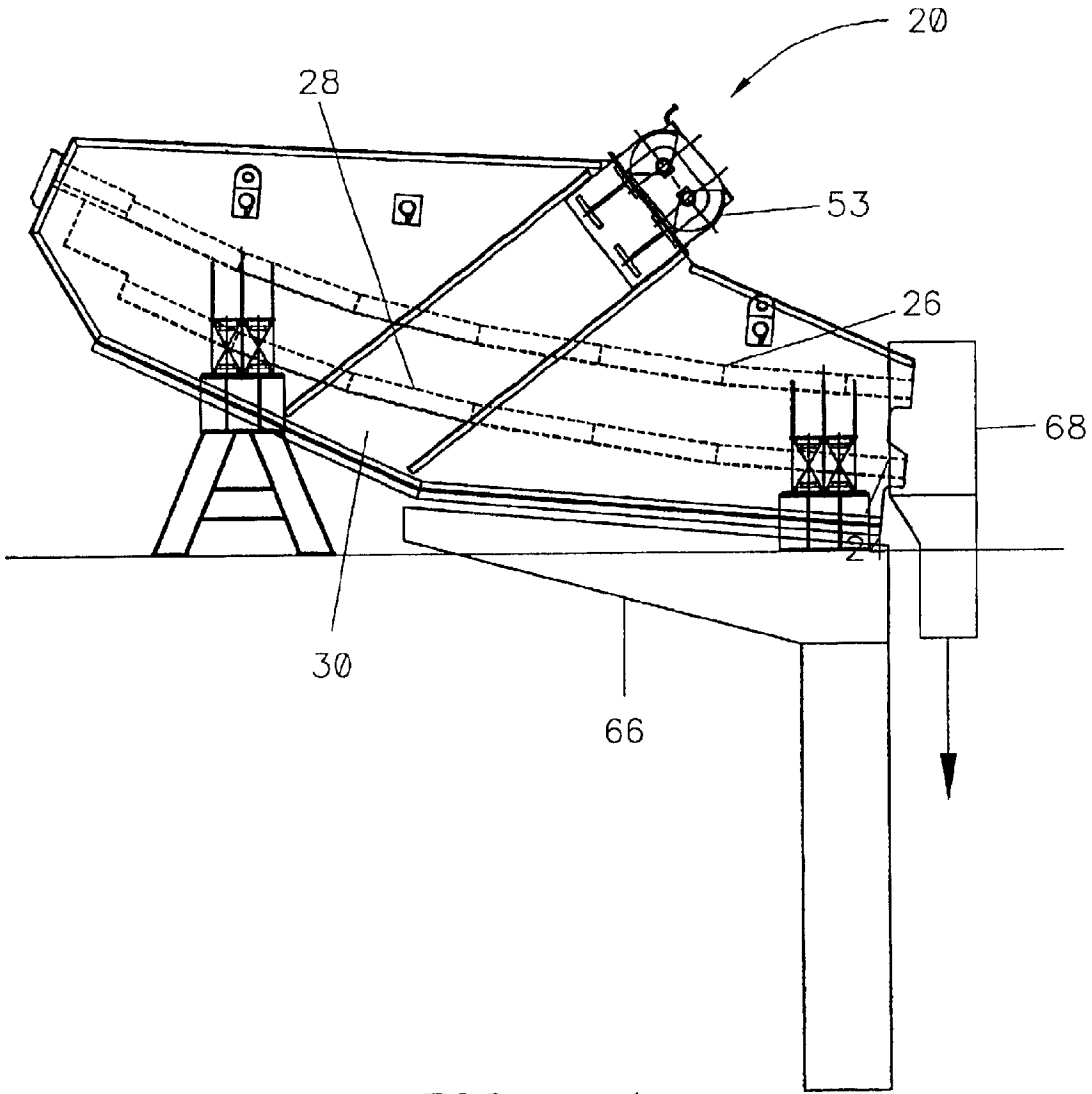
FIG. 4 is a side view a raw coal deslime section of the inventive screen assembly.
Figure 5:
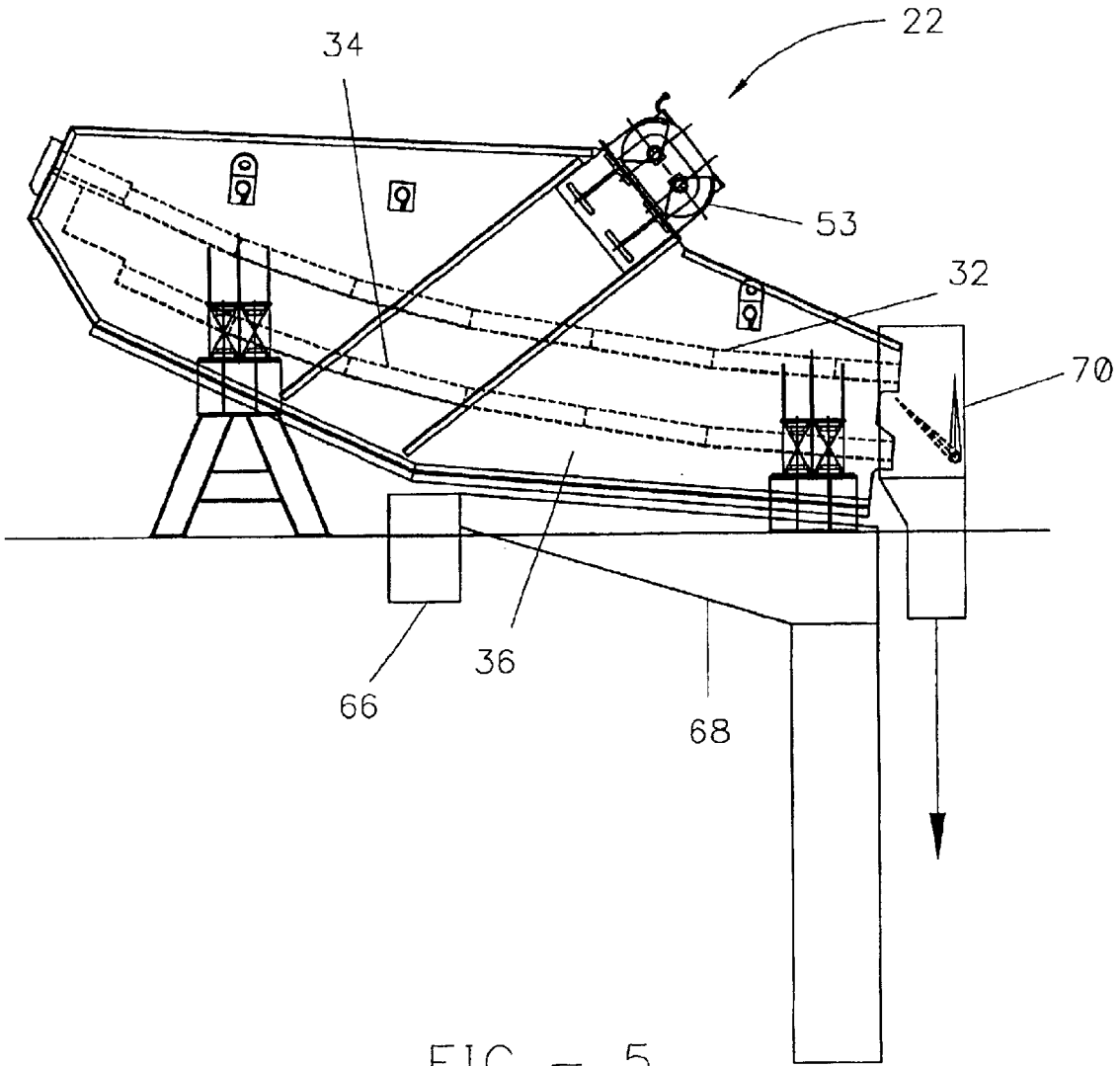
FIG. 5 is a side view of a refuse section of the inventive screen assembly.
Figure 6:
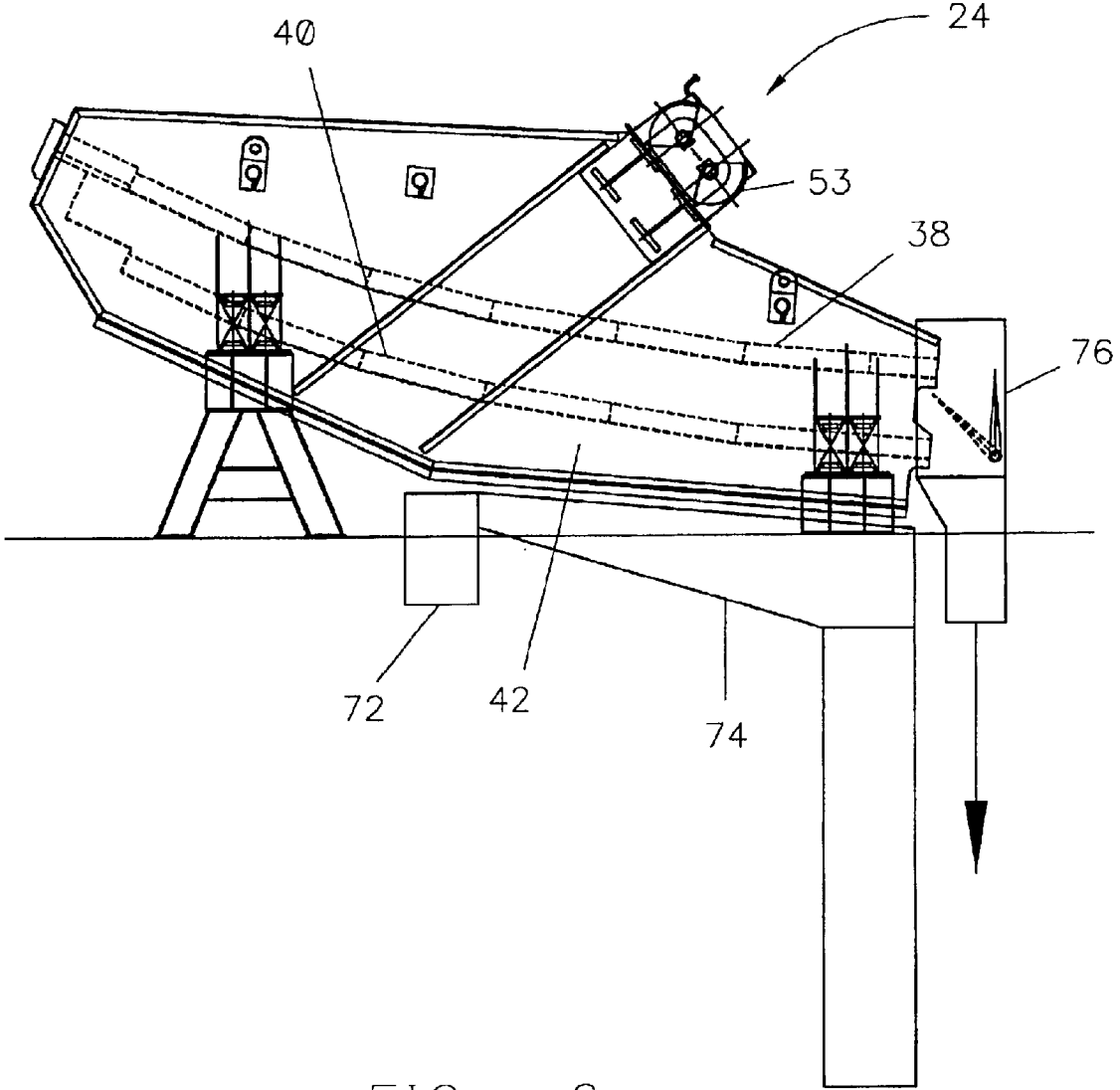
FIG. 6 is a side view of a clean coal section of the inventive screen assembly.

As shown in FIG. 2, the feed particles 14, 16 and 18 are provided at a first, or input, end 51 of the screen assembly 10, which is elevationally higher than a second, or output, end 52 of the screen assembly 10. The feed particles 14, 16 and 18 are moved along the length of the screen assembly 10 via gravitational forces acting thereon. To aid in particle separation through the screens, and also to help move the particles along the screens, the screens of the screen assembly 10 are conventionally vibrated using a standard vibration device 53 (see FIGS. 4–6).

As shown in FIG. 2, the coarse raw coal feed particles 14 screened by the top 26 and bottom 28 screens are fed to a first processing section 54 of the coal preparation plant 12. The processing section 54 utilizes conventional coal processing techniques to develop the clean coal 16 and the refuse 18 particles. Typically, these techniques will include heavy media separation methods. The finer sized raw coal feed particles 14 falling to the underpan 30 are fed to a second processing section 55 which conventionally processes those finer sized coal particles, typically using water based separation methods.

The solid refuse particles 18 screened by the top 32 and bottom 34 screens are fed to a conventional refuse handling section 56 of the coal preparation plant 12. Similarly, the solid clean coal particles 16 screened by the top 38 and bottom 40 screens are fed to a conventional coal clean handling section 58 of the coal preparation plant 12. Each of the finer sized refuse particles 18 and the finer sized clean coal particles 16 which are received in the underpans 36 and 42, respectively, are fed to both the first processing section 54 and the second processing section 55 for recirculation through and/or further processing by the coal preparation plant 12.

As shown in FIGS. 3–6, each of the screen sections 20, 22 and 24 includes sprayers 60 connected by valves 62 to a water source 64. As the respective feed particles 14, 16 and 18 move along the lengths of the respective screen sections 20, 22 and 24, they are sprayed with water. With regard to the deslime screen section 20, water is typically applied on the raw coal feed 14 to aid in separating the finer sized raw coal particles from the coarse raw coal particles. The water and finer sized raw feed particles which pass through the top 26 and bottom 28 screens and into the underpan 30 are fed to the second processing section 55 via conduit 66 The coarse raw coal feed particles screened by the top 26 and bottom 28 screens are fed to the first processing section 54 via conduit 68.

With respect to the refuse 22 and clean coal 24 screen sections, rinsing the particles with water is done for a different reason. Typically, magnetite is used as the media by the first processing section 54 for separating the clean coal from the refuse. The first processing section 54 produces the clean coal 16 and refuse 18 particles as slurries of solid clean coal/refuse, misplaced clean coal/refuse fines, magnetite and water. Rinsing the solid refuse and clean coal particles passing across the refuse 22 and clean coal 24 screen sections, respectively, is done primarily to recover the magnetite particles for recirculation through and/or further processing by the coal preparation plant 12.

The underpan 36 of the refuse screen section 22 is divided into a drain section 66 generally nearer the input end 51 and a rinse section 68 extending from the drain section 66 to the output end 52. Since the refuse feed 18 is received at the refuse screen section as a slurry of solid refuse, misplaced refuse fines, magnetite and water, the majority of the magnetite will be recovered from the refuse feed 18 in the drain section 66 of the underpan 36, as it will simply pass through the screens 32 and 34. However, the solid refuse particles screened by the screens 32 and 34 will have particles of magnetite adhering thereon. To recover this magnetite, the sprayers 60 are positioned to apply water to the screened solid refuse particles at the rinse section 68 of the underpan 36. The magnetite and misplaced refuse fines rinsed off of the screened refuse particles by the sprayers 60 are received in the rinse section 68. The slurry of water, magnetite and misplaced refuse fines from the drain section 66 is fed mainly to the first processing section 54, with a portion fed to the second processing section 55. The rinse section 68 of the underpan 36 will typically include less magnetite, and the slurry of water, magnetite and misplaced refuse fines from the rinse section 68 is fed to the second processing section 55. The solid refuse particles 18 screened by the top 32 and bottom 34 screens are conventionally fed to the refuse handling section 56 via conduit 70.

Similarly, the underpan 42 of the clean coal screen section 24 is divided into a drain section 72 generally nearer the input end 51 and a rinse section 74 extending from the drain section 72 to the output end 52. Since the clean coal 16 particles are received at the clean coal screen section as a slurry of solid clean coal, misplaced clean coal fines, magnetite and water, the majority of the magnetite will be recovered from the clean coal particles 16 in the drain section 72 of the underpan 42, as it will simply pass through the screens 38 and 40. However, the solid clean coal particles screened by the screen 38 and 40 will have particles of magnetite adhering thereon. To recover this magnetite, the sprayers 60 are positioned to apply water to the screened solid clean coal particles at the rinse section 74 of the underpan 42. The magnetite and misplaced clean coal fines rinsed off of the screened clean coal particles by the sprayers 60 are received in the rinse section 74. The slurry of water, magnetite and misplaced clean coal fines from the drain section 72 is fed mainly to the first processing section 54, with a portion fed to the second processing section 55. The rinse section 74 of the underpan 42 will typically include less magnetite, and the slurry of water, magnetite and misplaced clean coal fines from the rinse section 74 is fed to the second processing section 55. The solid clean coal particles 16 screened by the top 38 and bottom 40 screens are conventionally fed to the clean coal handling section 58 via conduit 76.

The above-described screen assembly 10 has the advantage that only one screen assembly is needed for processing all three different types of feed particles. Not only does this decrease costs and save space in the preparation plant, but a plant operator can view the screen assembly 10 and immediately observe the ratio of clean coal to refuse that is present in the incoming raw coal being processed. Since it is anticipated that the clean coal slurry 16 will be greater than the refuse slurry 18, the clean coal screen section 24 will be wider than the refuse screen section 22 to accommodate a higher volume. Using a 12'×20' (w×l) banana screen, it is presently suggested that a partitioning of 5' for the deslime section 20, 2' for the refuse section 22, and 5' for the clean coal section 24 be implemented. However, other screen sizes, partitioning widths, and relative feed locations are contemplated.

Additionally, since the underpans 36 and 42 of the refuse 22 and clean coal 24 screen sections, respectively, are similar in construction with the recovered materials received therein passed to the same sections within the coal preparation plant 12, the underpans 36 and 42 may be replaced with a single underpan 76 (see FIG. 2) underneath the screens of the refuse 22 and clean coal 24 screen sections.

While the present invention has been described with particular reference to the drawings, it should be understood that various modifications could be made without departing from the spirit and scope of the present invention. For instance while the inventive screen assembly 10 has been described herein as a double deck banana screen, a single deck banana screen, eliminating the bottom screens, may be utilized without departing from the spirit and scope of the present invention. Further, screens other than banana screens are contemplated and may be additionally implemented. Still further, while the inventive screen assembly 10 has been shown and described herein as used in a coal preparation plant 12, the inventive screen assembly 10 may be utilized in preparation plants for ore and minerals other than coal, using separation media other than magnetite, without departing from the spirit and scope of the present invention.

We claim:

1. In a mineral preparation plant receiving a raw mineral feed and separating the raw mineral feed into a clean mineral feed slurry and a refuse feed slurry, an apparatus for simultaneously processing the raw mineral feed and clean mineral and refuse feed slurries, said apparatus comprising:

a unitary screen assembly having a length and width, wherein the width of the unitary screen assembly is partitioned into three sections extending the length of the unitary screen assembly and including:

a deslime section receiving the raw mineral feed and separating the raw mineral feed into coarse and fine sized fractions as the raw mineral feed moves along the length of the deslime section;

a refuse section receiving the refuse feed slurry including solid refuse particles and a slurry of media and water and separating the solid refuse particles from the slurry of media and water as the refuse feed slurry moves along the length of the refuse section; and a clean mineral section receiving the clean mineral feed slurry including solid clean mineral particles and a slurry of media and water and separating the solid clean mineral particles from the slurry of media and water as the clean mineral feed slurry moves along the length of the clean mineral section;

a first feed supplying the raw mineral feed to the deslime section;

a second feed supplying the refuse feed slurry to the refuse section; and a third feed supplying the clean mineral feed slurry to the clean mineral section.

2. The apparatus of claim 1, wherein the deslime section includes a first screen having a first mesh allowing the raw mineral feed particles less than a first diameter to pass through, and a first underpan receiving the raw mineral feed particles passing through the first screen, the refuse section includes a second screen having a second mesh screening the solid refuse particles greater than a second diameter from the refuse feed slurry, and a second underpan receiving the slurry of media and water passing through the second screen, and the clean mineral section includes a third screen having a third mesh screening the solid clean mineral particles greater than a third diameter from the clean mineral slurry, and a third underpan receiving the slurry of media and water passing through the third screen.

3. The apparatus of claim 2, wherein the deslime section includes a fourth screen between the first screen and underpan having a fourth mesh allowing the raw mineral feed particles less than a fourth diameter to pass through the fourth screen to the first underpan, the fourth diameter being less than the first diameter, the refuse section includes a fifth screen between the second screen and underpan having a fifth mesh screening the solid refuse particles greater than a fifth diameter passing through the second screen and allowing the slurry of media and water to pass through to the second underpan, the fifth diameter being less than the second diameter, and the clean mineral second includes a sixth screen between the third screen and underpan having a sixth mesh screening the solid clean mineral particles greater than a sixth diameter passing through the third screen and allowing the slurry of media and water to pass through to the third underpan, the sixth diameter being less than the third diameter.

4. The apparatus of claim 2, wherein the refuse and clean mineral sections are adjacent one another, and wherein the second and third underpans comprise a single underpan receiving the slurries of media and water particles passing through the second and third screens.

5. The apparatus of claim 1, wherein the mineral comprises coal, and wherein the media comprises magnetite.

6. The apparatus of claim 1, further comprising first and second partition members extending along the length of the unitary screen assembly, the first partition member separating the deslime and refuse sections, and the second partition member separating the refuse and clean mineral sections.

7. The apparatus of claim 6, wherein the first and second partition members extend vertically and substantially normal to the unitary screen assembly.

8. The apparatus of claim 1, wherein the unitary screen assembly comprises a banana screen.

9. In a mineral preparation plant receiving a raw mineral feed and separating the raw mineral feed into a clean mineral feed slurry and a refuse feed slurry, an apparatus for simultaneously processing the raw mineral feed and clean mineral and refuse feed slurries, said apparatus comprising:

a unitary vibrating screen assembly having a length and a width, the respective particles moved along the unitary vibrating assembly screen length via gravitational and/or vibrational forces, wherein the width of the unitary vibrating screen assembly is partitioned into three sections extending the length of the unitary vibrating screen assembly and including:

a first screen section receiving the raw mineral feed and separating the raw mineral feed into coarse and fine sized fractions as the raw mineral feed move along the length of the first screen section;

a second screen section receiving the refuse feed slurry including solid refuse particles and a slurry of media and water and separating the solid refuse particles from the slurry of media and water as the refuse feed slurry moves along the length of the second screen section; and a third screen section receiving the clean mineral feed slurry including solid clean mineral particles and a slurry of media and water and separating the solid clean mineral particles from the slurry of media and water as the clean mineral feed slurry moves along the length of the third screen section;

a first feed supplying the raw mineral feed to the first screen section;

a second feed supplying the refuse feed slurry to the second screen section; and a third feed supplying the clean mineral feed slurry to the third screen section.

10. The apparatus of claim 9, wherein the first screen section includes a first screen having a first mesh screening the raw mineral feed particles greater than a first diameter, the screened raw mineral feed particles on the first screen passing to a first processing section of the mineral preparation plant, the second screen section includes a second screen having a second mesh screening the solid refuse particles greater than a second diameter from the refuse feed slurry, the screened solid refuse particles on the second screen passing to a refuse handling section of the mineral preparation plant, and the third screen section includes a third screen having a third mesh screening the solid clean mineral particles greater than a third diameter from the clean mineral feed slurry, the screened solid clean mineral particles on the third screen passing to a clean mineral handling section of the mineral preparation plant.

11. The apparatus of claim 10, wherein the first screen section includes a fourth screen directly below the first screen and having a fourth mesh screening the raw mineral feed particles greater than a fourth diameter passing through the first, the fourth diameter being less than the first diameter, the screened raw mineral feed particles on the fourth screen passing to the first processing section of the mineral preparation plant, the second screen section includes a fifth screen directly below the second screen and having a fifth mesh screening the solid refuse particles greater than a fifth diameter passing through the second screen from the refuse feed slurry, the fifth diameter being less than the second diameter, the screened solid refuse particles on the fifth screen passing to the refuse handling section of the mineral preparation plant, and the third screen section includes a sixth screen directly below the third screen and having a sixth mesh screening the solid clean mineral particles greater than a sixth diameter passing through the third screen from the clean mineral feed slurry, the sixth diameter being less than the third diameter, the screened solid clean mineral particles on the sixth screen passing to the clean mineral handling section of the mineral preparation plant.

12. The apparatus of claim 10, wherein the first screen section includes a first underpan receiving the raw mineral feed particles passing through the first screen, wherein the raw mineral feed particles received by the first underpan are passed to a second mineral processing section of the mineral preparation plant, the second screen section includes a second underpan receiving the slurry of media and water passing through the second screen, and the third screen section includes a third underpan receiving the slurry of media and water passing through the third screen.

13. The apparatus of claim 12, wherein the second and third underpans comprise a single underpan receiving the slurries of media and water passing through the second and third screens.

14. The apparatus of claim 12, wherein the second and third underpans each include drain and rinse sections, and wherein said apparatus further comprises at least one sprayer spraying rinse water onto the second and third screens at the rinse sections of their respective underpans to rinse off media adhering to the solid refuse and clean mineral particles on the second and third screens, respectively, wherein the rinse section of the second underpan receives a slurry of rinse water and media passing through the second screen, and wherein the rinse section of the third underpan receives a slurry of rinse water and media passing through the third screen.

15. The apparatus of claim 12, further comprising a water source providing water onto the raw mineral feed on the first screen, wherein the first underpan receives a slurry of water and fine sized raw mineral feed particles passing through the first screen.

16. The apparatus of claim 9, wherein the unitary vibrating screen assembly comprises a banana screen having first and second vertically extending partition members provided lengthwise along the banana screen, the first partition member separating the first and second screen sections, and the second partition member separating the second and third screen sections.

17. The apparatus of claim 16, wherein the banana screen comprises a double deck banana screen.

18. In a mineral preparation plant receiving a raw mineral feed and separating the raw mineral feed into a clean mineral feed and a refuse feed, an apparatus for simultaneously processing the raw mineral, clean mineral and refuse feeds, said apparatus comprising:

a unitary banana screen assembly configured for simultaneous processing of the raw mineral, clean mineral and refuse feeds, the unitary banana screen comprising:

a first screen deck having a length and a width, the first screen deck including first and second partition members extending the length of the first screen deck and partitioning the first screen deck into first, second and third screen sections for simultaneously processing the raw mineral, refuse and clean mineral feeds, respectively;

a first feed supplying the raw mineral feed to the first screen section;

a second feed supplying the refuse feed slurry to the second screen section; and a third feed supplying the clean mineral feed slurry to the third screen section.

19. The improved apparatus of claim 18, wherein the unitary banana screen further comprises:

a second screen deck positioned underneath the first screen deck and having a length and width corresponding thereto, the second screen deck including third and fourth partition members extending the length of the second screen deck and partitioning the second screen deck into first, second and third screen sections, corresponding to the first, second and third screen sections of the first screen deck, for further simultaneously processing the raw mineral, refuse and clean mineral feeds, respectively.

20. The improved apparatus of claim 19, wherein the unitary banana screen further comprises:

a first underpan positioned underneath the first screen section of the second screen deck for receiving a portion of the raw mineral feed passing through the first screen sections of the first and second screen decks; and a second underpan positioned underneath the second and third screen sections of the second screen deck for receiving portions or the refuse and clean mineral feeds passing through the second and third screen sections, respectively, of the first and second screen decks.

* * * * *